United States Patent [19]

Kublan

[11] 3,942,284

[45] Mar. 9, 1976

[54] DOLL WITH SEVEN SPHERICAL TORSO JOINTS AND FIVE APPENDAGES HELD BY THREE-SECURED ELASTIC MEMBERS

[75] Inventor: Neal Kublan, Brooklyn, N.Y.

[73] Assignee: Mego Corporation, New York, N.Y.

[22] Filed: Mar. 18, 1974

[21] Appl. No.: 451,827

[52] U.S. Cl. ..... 46/161

[51] Int. Cl.[2] ..... A63H 3/20

[58] Field of Search ..... 46/161

[56] References Cited

UNITED STATES PATENTS

| | | | |
|---|---|---|---|
| 130,068 | 7/1872 | Parent | 46/161 |
| 3,010,253 | 11/1961 | Ostrander | 46/161 |
| 3,277,602 | 10/1966 | Speers et al. | 46/161 |
| 3,634,966 | 1/1972 | Ostrander | 46/161 |

*Primary Examiner*—F. Barry Shay

[57] ABSTRACT

The present invention provides a jointed doll having a head, upper and lower torso sections, a pair of arms and a pair of legs. The arms are relatively movable with respect to the upper torso section and include an upper section and a forearm section. The legs are relatively movable with respect to the lower torso section and include a thigh portion and a lower section. Hands relatively movable with respect to the forearm sections and feet relatively movable to the lower sections of the legs are also provided. The upper and lower torso sections are coupled to each other by means of a spherical joint that permits universal movement of the upper and lower torso sections with respect to each other.

1 Claim, 5 Drawing Figures

DOLL WITH SEVEN SPHERICAL TORSO JOINTS AND FIVE APPENDAGES HELD BY THREE-SECURED ELASTIC MEMBERS

BACKGROUND OF THE INVENTION

1. Field of the Search

This invention relates to a jointed doll and more specifically to a doll having an improved spherical connection between the upper and lower torso sections thereof.

2. Description of the Prior Art

One example of the prior art structure is disclosed in U.S. Pat. No. 3,634,966 wherein a universal torso joint for a doll is disclosed. In the issued patent a spherical surface is formed at the lower end of the upper torso section and a partial spherical seat is formed at the upper portion of the lower torso section. When the spherical surface is mated with the partial spherical seat the two torso sections can move relative to each other in virtually any direction. However, because of limitations imposed by assembly requirements and by need to provide an accurate external appearance, the spherical surface is somewhat limited as regards the extent of its movement relative to the partial spherical seat. That is, the spherical seat which is integral with the lower torso section is relatively immobile while the spherical surface which is integral with the upper torso section moves relative thereto.

SUMMARY OF THE INVENTION

It is the general object of the present invention to avoid and overcome the foregoing and other difficulties with prior art jointed doll constructions by providing an inexpensive and relatively simple constructed universal joint for coupling the upper and lower torso sections of the doll.

BRIEF DESCRIPTION OF THE INVENTION

The foregoing object and other objects which will become more apparent as the description proceeds are achieved by providing an improved jointed doll comprising a body having an upper torso section, a pair of arms movably coupled to the upper torso section, a lower torso section, a pair of legs movably coupled to the lower torso section, a neck portion movably coupled to the upper torso section and a head movably mounted on the neck portion. The doll structure is completed by a spherical joint that couples the upper and lower torso sections to each other in order to permit the upper and lower torso sections to move relatively with respect to each other and with respect to the coupling means.

DESCRIPTION OF THE DRAWINGS

For a better understanding of the present invention reference should be had to the accompanying drawings wherein like numerals of reference indicate similar parts throughout the respective views and wherein.

DESCRIPTION OF THE PREFERRED EMBODIMENT

Figure 1:
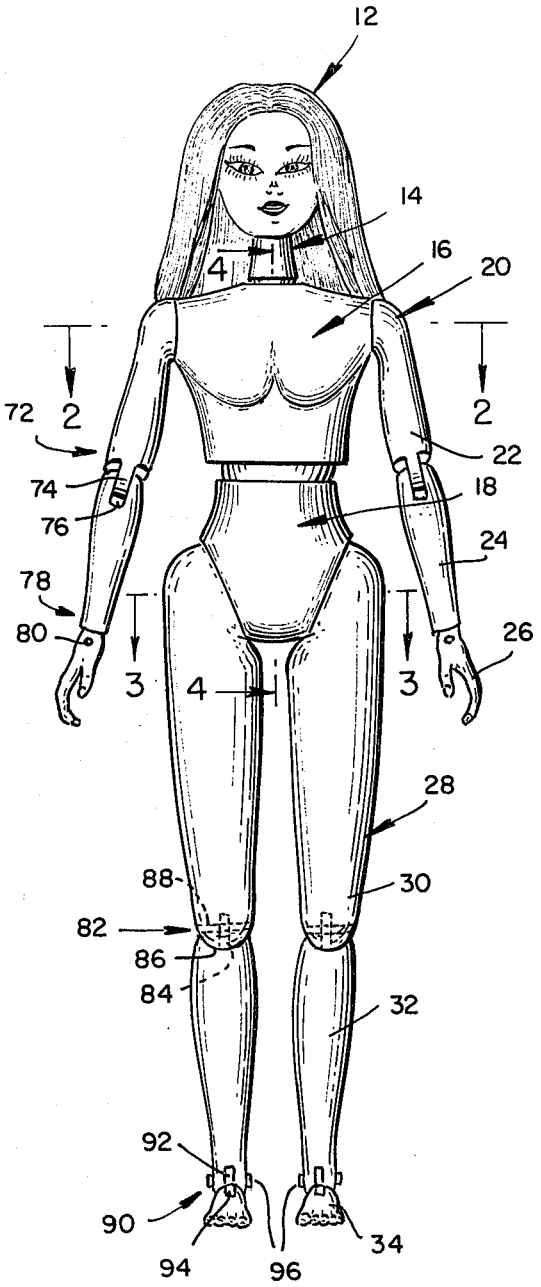
FIG. 1 is an elevational representation of the improved doll comprising the present invention.

Referring now to the drawings and in particular to FIG. 1, it will be seen that a doll 10 comprising the present invention includes a head portion 12, a neck section 14 on the upper end of which is mounted the head portion 12, an upper torso section 16 secured to the lower end of the neck section 14, and a lower torso section 18. A pair of arms 20, each of which includes an upper section 22, a forearm section 24, and a hand portion 26, is movably mounted on the upper torso section 16. A pair of legs 28, each of which includes a thigh section 30, a lower section 32 and a foot 34, are movably mounted on the lower torso section 18.

Figure 2:
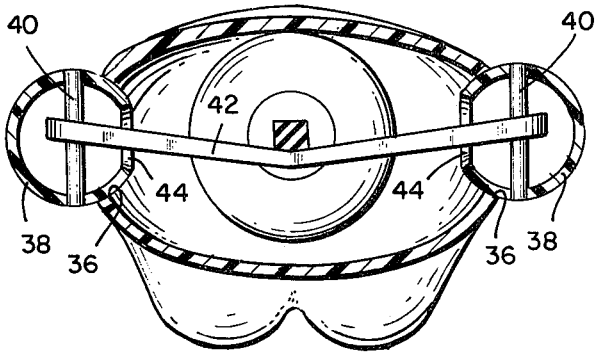
FIG. 2 is a transverse sectional view taken along line 2—2 of FIG. 1.

The meeans for mounting the arms 20 to the upper torso section 16 is best shown in FIG. 2. Therein it will be seen that the upper torso section is provided with a pair of oppositely facing spherical seats 36 that are arranged to receive the upper spherical end portions 38 of the upper section 22 of each arm 20. A pin 40 extends diametrically across the spherical section 38 and a resilient joiner member 42 is mounted on each of the pins 40. The joiner member 42 passes through an opening 44 formed in each of the spherical end sections 38. The pull of the resilient joiner member 42 is always directed to the center of the spherical sections 38 at the upper end of each arm 20.

Figure 3:
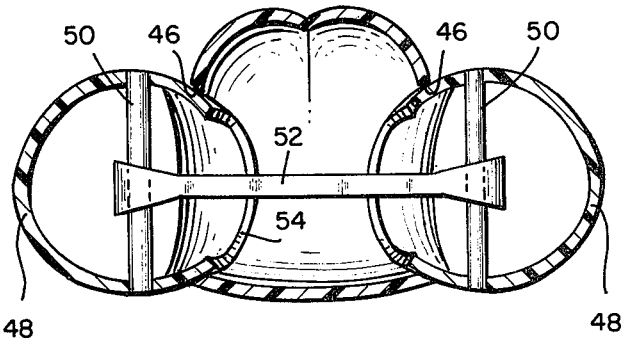
FIG. 3 is another transverse sectional view taken along line 3—3 of FIG. 1.

The means for mounting the thigh-portions 30 of the legs 28 to the lower torso section 18 is shown best in FIG. 3. The lower torso section 18 is provided with oppositely facing spherical seats 46 and are arranged to receive spherical surfaces 48 formed integrally with the upper end of each thigh section 30. A pin 50 is secured to and extends diametrically across the upper end of each thigh section 30 and has mounted thereon and therebetween a resilient joiner member 52 that extends through openings 54 formed integrally with the spherical surface 48 of the thigh sections 30. The pull of the resilient joiner member 52 is always directed to the center of the spherical portions 48 at the upper end of the thigh sections 30.

Figure 5:
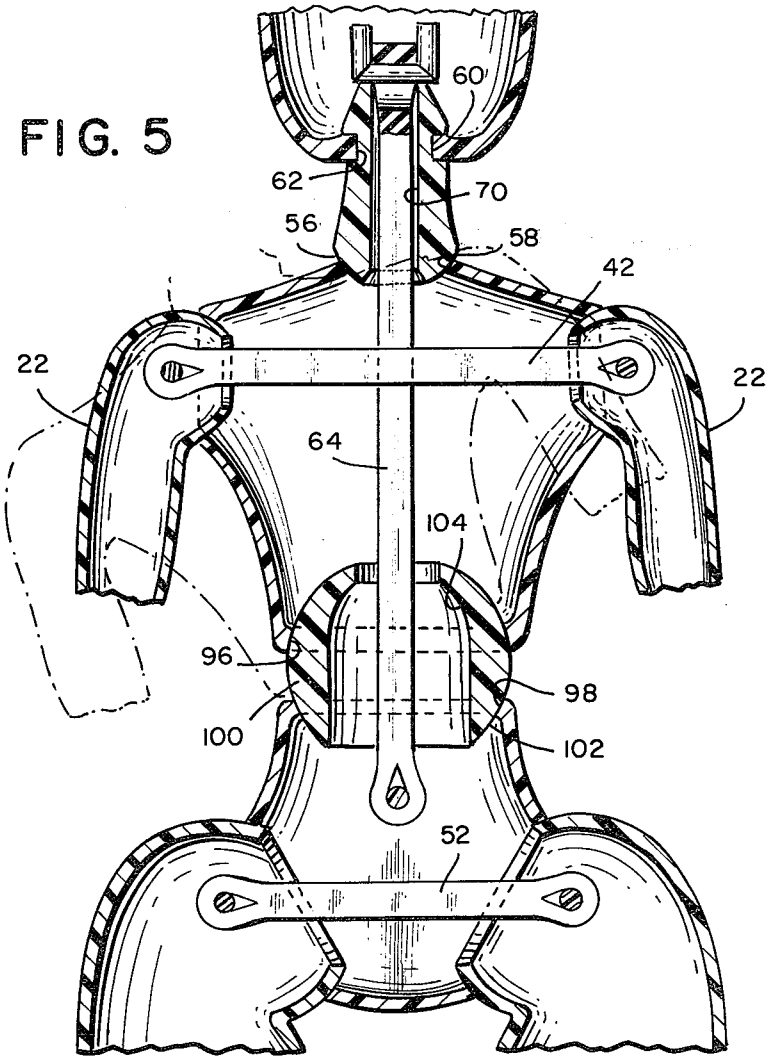
FIG. 5 is an elevational, sectional view taken along line 5—5 of FIG. 4.
Figure 4:
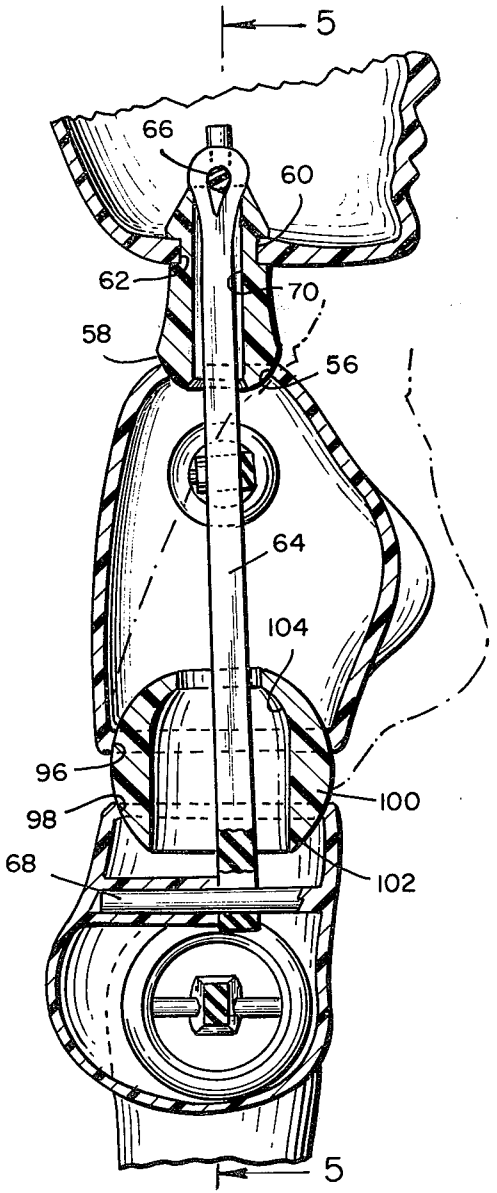
FIG. 4 is an elevational view taken along line 4—4 of FIG. 1.

The means for mounting the head portion 12 and the neck section 14 is shown in FIGS. 4 and 5. The upper end of the upper torso section 16 is provided with a spherical seat 56 in which is received a spherical surface 58 formed at the lower end of the tubular neck section 14. Proximate its upper end, the tubular neck section 14 is provided with an angular groove 60. A hole 62 is formed in the under surface of the head 12 in order to permit the neck section 14 to pass therethrough so that the head portion 12 may be snapped into the angular groove 16. A resilient joiner member 64 is mounted on and extends between pin 66 formed integrally within the head 12 and a pin 68 formed integrally within the lower torso section 18. A joiner member 64 extends through the longitudinal opening 70 formed in the tubular neck section 14.

By way of example, the elbow joint, the wrist joint, the knee joint, and the ankle joint of the doll 10 may be formed as shown in the aforementioned U.S. Pat. No. 3,364,966. Briefly, however, it may be noted that the elbow joint 72 is comprised of a projection 74 formed integrally with the upper section 22 of the arm 20. The projection 74 mates with a slot 76 formed in the forearm section of the arm 20. A pin (not shown) extends through the two spaced apart walls formed by the slot 76 as well as through the projection 74 to pivotly couple the upper section 22 and the forearm section 24 of the arm 20. The wrist joint 78 may be defined by a pin 80 that extends through and pivotly couples the hand 26 to the forearm section 24, for example, in the manner taught by U.S. Pat. No. 3,364,966.

The knee joint 82 is comprised of a projection 84 formed integrally with the upper end of the lower leg section 32. The projection 84 mates with a slot 86 formed in the lower end of the thigh section 28 and a pin 88 extends through the two spaced apart walls defined by the slot 86 as well as through the projection 84 to thereby pivotly couple the thigh section 28 to the lower leg section 32. The ankle section 90 may be formed by a projection 92 that is integral with the lower leg section 32 and which mates with a slot 94 formed integrally with the foot 34. A pin 96 extends through the two spaced apart walls defined by the slot 94 as well as through the projection 92 to thereby pivotly couple the foot 34 to the lower leg section 32.

Turning now to FIGS. 4 and 5, the means for coupling the upper torso section 16 to the lower torso section 18 will be described. It will be seen that the upper torso section 16 is provided with a spherical seat 96 at the lower end thereof while the lower torso section 18 is provided with a confronting spherical seat 98 at the upper end thereof. A coupling member 100 having an outer surface 102 that is at least partially spherical is mounted on the seats 96 and 98. The coupling member 100 is provided with a central bore 104 through which passes the joiner member 64 to thereby maintain the seats 96 and 98 of the upper and lower torso sections 16 and 18, respectively, in frictional contact with the partially spherical surface 102.

Because of the spherical coupling means between the upper and lower torso sections 16 and 18, respectively, the upper torso section 16 may be pivoted from front to back as shown by the phantom outline in FIG. 4. By the same construction the upper torso section 16 may be pivoted from right to left as shown in FIG. 5. It will, therefore, be evident that the upper torso section 16 may also assume any other angular position intermediate the positions shown in FIG. 4 and in FIG. 5 as well as any other angular orientation. Because the upper and lower torso sections 16 and 18, respectively, are spaced apart from each other in the direction of the height of the doll 10, there is virtually no limit to the positions that the upper torso section 16 may assume with respect to the lower torso section 18. In addition, it will be evident that the spherical coupling member 100 may also be angularly oriented with respect to either the upper torso section 16 or the lower torso section 18 because of the enlarged bore 104 that extends through spherical coupling member 100. Thus, not only the upper torso section 16 move in any angular direction with respect to the lower torso section 18 and the spherical member 100, but the spherical member 100 may also be angularly oriented either instead of or in addition to the upper torso section 16 with respect to the lower torso section 18.

It will be recognized by those skilled in the art that the object of the present invention has been achieved by providing an improved spherical joint between the upper and lower torso sections in addition to the spherical joints for the coupling between the arms in the upper torso section as well as between the legs and the lower torso section. The novel spherical coupling means between the upper and lower torso sections provides an unlimited range of movement.

While in accordance with the patent statutes the preferred embodiment of the present invention has been described in detail, it should be particularly understood that the invention is not limited thereto or thereby.

I claim:

1. A jointed doll comprising a body, said body including an upper torso section and a lower torso section, a head, a pair of legs moveably coupled to said upper torso section, a pair of arms moveably coupled to said upper torso section, said upper torso section including a first spherical seat and a second spherical seat, said first and second spherical seats spaced apart from each other and facing in opposite directions, one of said arms including a spherical surface positioned in said first spherical seat in said upper torso section and said other arm including a spherical surface positioned in said second spherical seat in said upper torso section, a first pin located in the upper portion of one of said arms and a second pin located in the upper portion in the other of said arms, said first and second pins being parallel to each other, an opening extending through said first and second spherical surfaces and an opening extending through said first and second spherical seats, a resilient member secured to said first pin, passing through said openings in said first spherical seat and second spherical seat, passing through said openings in said first and second spherical surfaces and secured to said second pin to urge said first and second spherical surfaces to remain in said first and second spherical seats, a spherical coupling member, said upper torso section including a spherical seat at its bottommost portion, said lower torso section including a spherical seat at its uppermost portion, said spherical coupling member seated on said spherical seat at the upper portion of said lower torso section and on the spherical seat at the lower portion of said upper torso section, said spherical coupling member including a hollow interior, a pin extending transversely through the interior of said lower torso section, a spherical seat located at the upper portion of said upper torso section, said head including a pin extending transversely through the interior thereof, an opening defined at the bottom portion of the head, a head coupling member including a spherical surface at its lowermost portion seated in said spherical seat at the uppermost portion of said upper torso section, said head coupling member including a groove that receives the bottom portion of said head which defines said head portion opening, said head coupling member including material above and below said groove which abuts said bottom portion of said head, said head coupling member being hollow, an elastic member secured to said pin in the interior of said head, extending through said head coupling member, through said upper torso section, through said spherical coupling member and secured to said pin in said lower torso section, said lower torso section including first and second spherical seats, each leg including a spherical surface at its uppermost portion, a pin located in the upper portion of each leg, an opening extending through the spherical surface of each leg, the pins in the upper portions of said legs being parallel to each other, the spherical surface of each leg being seated in a respective spherical seat of the lower torso section, an elastic member secured to the pins in the upper portions of said legs and extending through the spherical surface of each leg and through the lower torso section.

* * * * *